US005161551A

United States Patent [19]

Sanders et al.

[11] Patent Number: 5,161,551

[45] Date of Patent: Nov. 10, 1992

[54] PAPER WRAPPER HAVING IMPROVED ASH CHARACTERISTICS

[75] Inventors: Edward B. Sanders; Sheryl D. Baldwin, both of Richmond; Barbro L. Goodman, Colonial Heights; Cynthia W. Arterbery, Chesterfield; James L. Myracle, Midlothian, all of Va.

[73] Assignee: Philip Morris Incorporated, New York, N.Y.

[21] Appl. No.: 684,568

[22] Filed: Apr. 12, 1991

[51] Int. Cl.[5] ..... A24D 1/02

[52] U.S. Cl. ..... 131/365; 131/331

[58] Field of Search ..... 131/365, 331

[56] References Cited

U.S. PATENT DOCUMENTS

| | | | |
|---|---|---|---|
| Re. 23,794 | 3/1954 | Schur et al. . | |
| 2,538,802 | 1/1951 | Schur et al. . | |
| 2,580,568 | 1/1952 | Matthews et al. . | |
| 2,580,608 | 1/1952 | Schur et al. . | |
| 2,580,609 | 1/1952 | Schur et al. . | |
| 2,580,610 | 1/1952 | Schur et al. . | |
| 2,580,611 | 1/1952 | Schur et al. . | |
| 2,673,565 | 3/1954 | Schur et al. . | |
| 2,733,720 | 2/1956 | Schur et al. . | |
| 3,744,496 | 7/1973 | McCarty et al. | 131/365 |
| 3,805,802 | 4/1974 | Hedge et al. . | |
| 3,885,574 | 5/1975 | Borthwick et al. . | |
| 4,008,723 | 2/1977 | Borthwick et al. . | |
| 4,133,317 | 1/1979 | Briskin . | |
| 4,231,377 | 11/1980 | Cline et al. . | |
| 4,407,308 | 10/1983 | Baker et al. . | |
| 4,420,002 | 12/1983 | Cline . | |
| 4,450,847 | 5/1984 | Owens . | |
| 4,453,553 | 6/1984 | Cohn . | |
| 4,461,311 | 7/1984 | Mathews et al. . | |
| 4,548,677 | 10/1985 | Scheider et al. . | |
| 4,561,454 | 12/1985 | Guess | 131/365 |
| 4,615,345 | 10/1986 | Durocher . | |
| 4,622,983 | 11/1986 | Mathews et al. . | |
| 4,624,268 | 11/1986 | Baker et al. | 131/365 |
| 4,805,644 | 2/1989 | Hampl, Jr. et al. . | |
| 4,881,557 | 11/1989 | Martin . | |
| 4,911,184 | 3/1990 | Case et al. . | |
| 4,915,118 | 4/1990 | Kaufman et al. . | |
| 4,920,990 | 5/1990 | Lawrence et al. | 131/365 |

FOREIGN PATENT DOCUMENTS

| | | |
|---|---|---|
| 702920 | 2/1965 | Canada . |
| 0402059 | 12/1990 | European Pat. Off. . |
| 59-94700 | 5/1984 | Japan . |
| 1533323 | 11/1978 | United Kingdom . |

OTHER PUBLICATIONS

Resnick, et al., Factors Affecting Static Burning Rate, Tobacco Science, vol. 21, pp. 103–107, 1977.

Schur, et al., The Design of Low Yield Cigarettes, Tobacco Science, vol. 4, pp. 69–77, 1960.

Owens, Effect of Cigarette Paper on Smoke Yield and Composition, Recent Advances in Tobacco Science, vol. 4, pp. 3–24, 32nd Tobacco Chemists' Research Conference, Oct. 30–Nov. 1, 1978 Montreal, Canada.

*Primary Examiner*—Vincent Millin
*Assistant Examiner*—Lynne A. Reichard
*Attorney, Agent, or Firm*—Loretta A. Miraglia

[57] ABSTRACT

The ash characteristics of a cigarette paper wrapper are improved by using fine particle size calcium carbonate filler. In addition, increased calcium carbonate filler loading level, increased basis weight, and various combinations of these variables are used to achieve improved ash characteristics.

28 Claims, No Drawings

PAPER WRAPPER HAVING IMPROVED ASH CHARACTERISTICS

BACKGROUND OF THE INVENTION

The present invention relates to a paper wrapper construction for use in conjunction with a smoking article, such as a cigarette. Specifically, the paper wrapper of the invention has improved ash characteristics.

The optimum cigarette paper ash should adhere to the tobacco ash and blend in with the tobacco ash to provide an aesthetically pleasing appearance. It is important for the cigarette paper ash to adhere to the tobacco ash to avoid excessive flaking. However, the cigarette paper ash should be capable of being easily flicked off at the will of the smoker. Preferably the cigarette paper ash should consist of fine flakes of a highly cohesive character.

Conventional cigarettes having high levels of expanded tobacco filler exhibit excessive ash flaking with typical cigarette paper wrappers. Previous efforts to improve the ash characteristics of such cigarettes have required excessively high levels or unusual types of ash modifiers. However, this approach may impart negative taste attributes to the cigarette.

It would be desirable to provide a paper wrapper for a smoking article that has improved ash characteristics.

It would also be desirable to provide a paper wrapper for a smoking article that produces an ash that blends in with the tobacco ash to provide an aesthetically pleasing appearance.

It would further be desirable to provide a paper wrapper for a smoking article that produces an ash that adheres to the tobacco ash, but that is also capable of being easily flicked off at the will of the smoker.

It would further be desirable to provide a paper wrapper for a smoking article that produces an ash that is more cohesive on the cigarette rod.

It would further be desirable to provide a paper wrapper for a smoking article that does not require excessively high levels or unusual types of ash modifiers and does not impart negative taste attributes to the smoking article.

SUMMARY OF THE INVENTION

It is therefore an object of this invention to provide a paper Wrapper for a smoking article that ha improved ash characteristics.

It is another object of this invention to provide a paper wrapper for a smoking article that produces an ash that blends in with the tobacco ash to provide an aesthetically pleasing appearance.

It is a further object of this invention to provide a paper wrapper for a smoking article that produces an ash that adheres to the tobacco ash and is cohesive, but that is also capable of being easily flicked off at the will of the smoker.

It is a further object of this invention to provide a paper wrapper for a smoking article that produces an ash that is more cohesive on the cigarette rod.

It is a further object of this invention to provide a paper wrapper for a smoking article that does not require excessively high levels or unusual types of ash modifiers and does not impart negative taste attributes to the smoking article.

In accordance with this invention there is provided a paper wrapper for a smoking article, such as a cigarette, that has improved ash characteristics. These improved ash characteristics include providing an ash that blends in with and adheres to the tobacco ash to provide an aesthetically pleasing appearance and consists of fine flakes of a highly cohesive character. The paper wrapper of this invention does not require excessively high levels or unusual types of ash modifiers. Instead, the paper wrapper of this invention may use fine particle size calcium carbonate (or chalk) filler, an increased level of calcium carbonate filler, an increased basis weight, or various combinations of any of the above to achieve the improved ash characteristics and improved taste attributes.

The paper wrapper of this invention may be used for cigarettes of any length or circumference. Cigarettes made with the paper wrapper of this invention may have different fillers, such as tobacco, expanded tobacco, a variety of blend types, reconstituted tobacco materials, non-tobacco filler materials, and combinations thereof. The paper wrapper of this invention is especially suited for use with expanded tobacco fillers because there is no need for excessively high levels or unusual types of ash modifiers to strengthen the ash.

DETAILED DESCRIPTIONS OF THE INVENTION

The paper wrapper of this invention may be made from flax or other cellulosic fibers. Calcium carbonate is used as a filler. The mean particle size of the calcium carbonate should be between about 0.02 microns and about 2 microns. Preferably the mean particle size should be between about 0.02 microns and about 1.3 microns, and most preferably should be about 0.07 microns. A typical commercial brand of calcium carbonate having the 0.07 micron particle size is known by the brand name MULTIFEX TM, available from Pfizer Minerals, Pigments, and Metals Division of Pfizer, Inc., New York, N.Y. Mixtures of calcium carbonate types with differing particle sizes may also be advantageous. For example, mixtures may be used incorporating between about 5% by weight and about 15% by weight of larger particle size calcium carbonate, such as ALBACAR ®, the brand name for calcium carbonate with the standard particle size of between about 2 microns and about 3 microns, available from Pfizer Minerals, Pigments, and Metals Division of Pfizer, Inc., New York, N.Y., with smaller particle size calcium carbonate, such as MULTIFEX MM TM. Other mixtures may also be used and are not limited to the combination and range of this example.

The calcium carbonate should have a filler loading level of between about 27% by weight and about 40% by weight. Preferably the calcium carbonate filler level is between about 33% by weight and about 36% by weight.

The paper wrapper may also have a basis weight of between about 25 g/m$^2$ and about 39 g/m$^2$. Preferably the basis weight should be about 30 g/m$^2$. It is desirable to have increased basis weight when using MULTIFEX MM TM calcium carbonate in high porosity ranges because this imparts improved tensile properties to the paper.

The porosity of the paper wrapper should be between about 15 Coresta units and about 50 Coresta units, preferably between about 20 Coresta units and about 35 Coresta units, or between about 40 Coresta units and about 50 Coresta units, depending on the type of cigarette. For example, a porosity of between about 20

Coresta units and about 35 Coresta units is preferred for cigarettes with intermediate levels of tar and for full flavor cigarettes. A porosity of between about 40 Coresta units and about 50 Coresta units is preferred for ultra low delivery cigarettes, which generally contain high levels of expanded tobacco.

The paper may also be treated with low to moderate levels (between about 0.5% by weight and about 3% by weight, preferably between about 1% by weight and about 1.7% by weight) of a burn control additive. Such a burn control additive is an alkali metal salt, preferably a citrate, such as potassium citrate. Alkali acetates, fumarates, succinates, tartrates, phosphates, or mixtures thereof may also be used. High alkali metal levels impart negative taste attributes to the cigarette. The use of lower levels of a burn control additive improves the taste of the cigarette. The burn control additive is used to help improve the ash characteristics and to control the puff count and the burn rate of the cigarettes. Generally, there is an optimum level of burn control additive depending on the other properties of the paper (basis weight, calcium carbonate content, calcium carbonate particle size, and porosity) and the blend of cigarette filler used with respect to ash appearance. For example, with a typical paper of 25 g/m$^2$ basis weight, 27% ALBACAR® calcium carbonate, and a high expanded tobacco blend, the optimum level of burn control additive is about 1.5% by weight. The optimum level may be determined by simple experimentation for each paper and blend type.

A particular example of the paper wrapper of this invention has calcium carbonate with a mean particle size of about 0.07 microns. The calcium carbonate filler loading is between about 33% by weight and about 36% by weight. The paper wrapper also has a basis weight of about 30 g/m$^2$. In addition, the paper wrapper has a porosity of between about 15 Coresta units and about 50 Coresta units and is coated with between about 1% by weight and about 1.7% by weight of a burn control additive.

EXAMPLE 1

Paper wrappers were made from paper handsheets, prepared in the laboratory, having 36% by weight MULTIFEX MM TM calcium carbonate filler with a mean particle size of about 0.07 microns. The handsheets were coated with either 1% by weight or 2% by weight of an alkali metal citrate, and had porosities from 30 Coresta units to 38 Coresta units. The handsheets had basis weights of 30 g/m$^2$ and 35 g/m$^2$. A control with calcium carbonate having a mean particle size of between about 2 microns and about 3 microns was used. Handmade cigarette models were made using these paper wrappers and tobacco filler with moderate levels (20%) of expanded tobacco. Evaluation under dynamic conditions demonstrated that the fine particle size calcium carbonate (0.07 microns) gave an improvement in ash appearance and cohesiveness with both 30 g/m$^2$ and 35 g/m$^2$ basis weight papers.

EXAMPLE 2

Paper wrappers were made from paper handsheets, prepared in the laboratory, having 30% by weight and 36% by weight MULTIFEX MM TM calcium carbonate filler with a mean particle size of 0.07 microns. The handsheets had a basis weight of 35 g/m$^2$, a porosity of between about 26 Coresta units and about 37 Coresta units, and an alkali metal citrate level of between about 0.6% by weight and about 2.5% by weight. Handmade cigarette models were made using the paper wrappers. Evaluation of the handmade cigarette models demonstrated improved ash appearance and cohesiveness. The higher calcium carbonate level (36%) was more effective in improving ash than the 30% calcium carbonate level. In addition, the 30% level showed improved ash when compared to typical cigarette wrappers having 25% by weight calcium carbonate.

EXAMPLE 3

Machine made cigarettes were constructed with different wrappers in a regular circumference of 24.8 mm with a 31.5 mm long filter ventilated to 42% and a 67 mm long tobacco column. The wrappers had basis weights of 25 g/m$^2$, 30 g/m$^2$ and 35 g/m$^2$. These paper wrappers were made with 30% calcium carbonate filler having a mean particle size of 2 microns, a porosity of 35 Coresta units, and alkali metal citrate levels of 1.0%, 1.7% and 2.5% by weight. Evaluation under static burning conditions assessed cracking and flaking of the paper ash. Static smoking showed that the cigarettes made from paper wrappers having higher basis weights (30 g/m$^2$ and 35 g/m$^2$) gave an ash with significantly less cracking and flaking than did the lower basis weight paper (25 g/m$^2$).

Similar results were seen for dynamically puffed cigarettes. A puffing machine was used that holds 5 cigarettes in a horizontal position. The cigarettes are puffed at 1 minute intervals. The ash remains on the cigarette rod as the cigarette is puffed. The ash was evaluated and showed similar results to those evaluated under static smoking conditions. Thus, the benefit of increasing basis weight was shown with the larger particle size calcium carbonate.

EXAMPLE 4

Machine made cigarettes were constructed with different wrappers in a regular circumference of 24.8 mm with a 31.5 mm long filter ventilated to 42% and a 67 mm long tobacco column. The cigarette rod contained 20% expanded tobacco by weight. The wrappers were in the 30 to 36 Coresta unit range and contained 30% calcium carbonate filler with 2.5% by weight of citrate additive. The mean particle size of the calcium carbonate was either 0.07 microns or 2 microns. The evaluation of the extent of flaking and cracking of the ash was done while the cigarettes were smoked statically in a vertical position. The laboratory used for the testing was conditioned to 75° F and 60% relative humidity. A rating scale from 1=perfectly solid to 5=large flakes was used. The ash ratings are based on the average of 5 cigarettes. The results are shown in Table 1.

TABLE 1

Effect of Calcium Carbonate Size on Ash Flaking

| Particle Size | Basis Weight | Ash Rating | |
|---|---|---|---|
| 2 microns | 25 g/m$^2$ | 3.1 | Control |
| 0.07 microns | 25 g/m$^2$ | 2.5 | Test |

This demonstrates that a smaller calcium carbonate particle size gives a more cohesive ash.

EXAMPLE 5

Machine made cigarettes were constructed with different wrappers in a regular circumference of 24.8 mm with a 31.5 mm long filter ventilated to about 60% and a 67 mm long tobacco column. The cigarette rod contained 50% expanded tobacco by weight. The wrappers were in the 30 to 36 Coresta unit range, contained ALBACAR® calcium carbonate (2 microns), and were coated with 1.7% by weight alkali metal citrate. The wrappers contained varying levels of calcium carbonate filler: 25% by weight, 30% by weight, and 36% by weight. The cigarettes were smoked in a horizontal position during puffing at one minute intervals. The beneficial effect of increased calcium carbonate content is shown in Table 2. Note that paper wrappers with the 2 micron particle size calcium carbonate can show an improvement in ash rating when the calcium carbonate filler level is increased.

TABLE 2

Effect of Calcium Carbonate Content on Ash Flaking.

| % Calcium carbonate | Particle Size | Ash Rating |
|---|---|---|
| 25 | 2 microns | 2.6 |
| 30 | 2 microns | 2.2 |
| 36 | 2 microns | • 2.0 |

EXAMPLE 6

Machine made cigarettes were constructed with different wrappers in a regular circumference of 24.8 mm with a 31.5 mm long filter ventilated to about 60% and a 67 mm long tobacco column. The cigarette rod contained 50% expanded tobacco by weight. The wrappers were in the 30 to 36 Coresta unit range and were coated with 1.7% by weight of an alkali metal citrate. The test wrappers contained MULTIFEX MM TM calcium carbonate (0.07 microns). A control was used containing ALBACAR® calcium carbonate (2 microns). Evaluation under dynamic smoking conditions showed improved ash ratings with the finer particle size calcium carbonate. See Table 3.

TABLE 3

Effect of Calcium Carbonate Particle Size on Ash Flaking

| % Calcium Carbonate | Particle Size | Ash Rating | |
|---|---|---|---|
| 25 | 2 microns | 2.6 | Control |
| 25 | 0.07 microns | 1.7 | Test 1 |
| 30 | 0.07 microns | 1.8 | Test 2 |
| 36 | 0.07 microns | 1.8 | Test 3 |

The test wrappers also contained varying levels of calcium carbonate: 25% by weight, 30% by weight and 36% by weight. Comparison of the ash ratings shown in Table 3 with those in Table 2 show the benefit of the finer particle size at each level of calcium carbonate. Note that the effect of increased calcium carbonate level is less significant with the smaller particle size than it is with the larger particle size calcium carbonate (see Example 5) under these specific test conditions and with these machine-made cigarettes.

Thus it is seen that the paper wrapper of this invention for use with a smoking article has improved ash characteristics because it produces an ash that blends in with the tobacco ash to provide an aesthetically pleasing appearance and that adheres to the tobacco ash but is also capable of being easily flicked off at the will of the smoker. One skilled in the art will appreciate that the present invention can be practiced by other than the described embodiments, which are presented for purposes of illustration and not of limitation, and the present invention is limited only by the claims that follow.

What is claimed is:

1. A paper wrapper for a smoking article comprising:

a calcium carbonate filler loading of between 28% by weight and about 40% by weight, the calcium carbonate having a particle size of between about 0.02 microns and about 2 microns; and a basis weight of between about 25 g/m$^2$ and about 39 g/m$^2$.

2. The paper wrapper of claim 1 wherein the calcium carbonate filler loading is between about 30% by weight and about 36% by weight.

3. The paper wrapper of claim 1 wherein the calcium carbonate has a mean particle size of about 2 microns.

4. The paper wrapper of claim 3 wherein the calcium carbonate filler loading is about 36% by weight, and the basis weight is about 28 g/m$^2$.

5. The paper wrapper of claim 1 wherein the basis weight is about 30 g/m$^2$.

6. The paper wrapper of claim 3 wherein the basis weight is about 30 g/m$^2$.

7. The paper wrapper of either of claims 1 or 4 having an inherent porosity of between about 20 Coresta units and about 35 Coresta units.

8. The paper wrapper of either of claims 1 or 4 having an inherent porosity of between about 40 Coresta units and about 50 Coresta units.

9. The paper wrapper of either of claims 1 or 4 further comprising a burn control additive, wherein the burn control additive level is between about 0.5% by weight and about 3% by weight.

10. The paper wrapper of claim 9 wherein the burn control additive level is between about 1% by weight and about 1.7% by weight.

11. A smoking article comprising a smokeable filler surrounded by a paper wrapper, the paper wrapper having a calcium carbonate filler loading of between 28% by weight and about 40% by weight, the calcium carbonate having a particle size of between about 0.02 microns and about 2 microns; and a basis weight of between about 25 g/m$^2$ and about 39 g/m$^2$.

12. The smoking article of claim 11 wherein the calcium carbonate filler loading is between about 30% by weight and about 36% by weight.

13. The smoking article of claim 11 wherein the calcium carbonate has a mean particle size of about 2 microns.

14. The smoking article of claim 13 wherein the calcium carbonate filler loading is 36% by weight, and the basis weight is about 28 g/m$^2$.

15. The smoking article of claim 11 wherein the basis weight is about 30 g/m$^2$.

16. The smoking article of claim 13 wherein the basis weight is about 30 g/m$^2$.

17. The smoking article of either of claims 11 or 14 having an inherent porosity of between about 20 Coresta units and about 35 Coresta units.

18. The smoking article of either of claims 11 or 14 having an inherent porosity of between about 40 Coresta units and about 50 Coresta units.

19. The smoking article of either of claims 11 or 14 wherein the paper wrapper further comprises a burn control additive, wherein the burn control additive level is between about 0.5% by weight and about 3% by weight.

20. The smoking article of claim 19 wherein the burn control additive level is between about 1% by weight and about 1.7% by weight.

21. A paper wrapper for a smoking article comprising:

a calcium carbonate filler having a mean particle size of about 0.7 microns;

a calcium carbonate filler loading of between about 27% by weight and about 40% by weight; and a basis weight of between about 25 $g/m^2$ and about 39 $g/m^2$.

22. The paper wrapper of claim 21 wherein the calcium carbonate filler loading is between about 30% by weight and about 36% by weight.

23. The paper wrapper of claim 21 wherein the basis weight is about 30 $g/m^2$.

24. A smoking article comprising a smokeable filler surrounded by a paper wrapper, the paper wrapper having a calcium carbonate filler having a means particle size of about 0.07 microns;

a calcium carbonate filler loading of between about 27% by weight and about 40% by weight; and a basis weight of between about 25 $g/m^2$ and about 39 $g/m^2$.

25. The smoking article of claim 24 wherein the calcium carbonate filler loading is between about 30% by weight and about 36% by weight.

26. The smoking article of claim 24 wherein the basis weight is about 30 $g/m^2$.

27. A method for improving the ash characteristics of a smoking article having a smokeable filler surrounded by a paper wrapper, having a basis weight of between about 25 $g/m^2$ and about 39 $g/m^2$, comprising adding a calcium carbonate filler in an amount to achieve a calcium carbonate filler loading of between 28% by weight and about 40% by weight and a particle size of between about 0.02 microns and about 2 microns.

28. A method for improving the ash characteristics of a smoking article having a smokeable filler surrounded by a paper wrapper comprising adding a calcium carbonate filler wherein the calcium carbonate filler has a mean particle size of about 0.07 microns.

* * * * *